United States Patent [19]

Cox

[11] 4,116,284

[45] Sep. 26, 1978

[54] EARTH DRILLS

[76] Inventor: Van R. Cox, P.O. Box 840, Livingston, Tex. 77351

[21] Appl. No.: 805,295

[22] Filed: Jun. 10, 1977

[51] Int. Cl.[2] ..... E21B 3/02

[52] U.S. Cl. ..... 173/140; 175/170; 173/26; 173/30

[58] Field of Search ..... 173/26, 38, 40, 41, 173/140; 175/170

[56] References Cited

U.S. PATENT DOCUMENTS

| | | | |
|---|---|---|---|
| 472,444 | 4/1892 | Fish | 173/140 X |
| 2,217,300 | 10/1940 | Templeton | 173/140 X |
| 2,576,199 | 11/1951 | Vogel | 173/140 X |
| 2,696,972 | 12/1954 | Howe | 173/140 |
| 2,746,720 | 5/1956 | Cannon | 175/170 X |
| 2,959,398 | 11/1960 | Troche | 173/140 X |
| 3,828,861 | 8/1974 | Verkuil | 173/140 X |
| 3,976,147 | 8/1976 | Cunningham | 173/140 X |
| 4,057,114 | 11/1977 | Anderson | 173/140 X |

FOREIGN PATENT DOCUMENTS

| | | | |
|---|---|---|---|
| 150,764 | 4/1953 | Australia | 173/40 |

*Primary Examiner*—Lawrence J. Staab
*Attorney, Agent, or Firm*—Jack W. Hayden

[57] ABSTRACT

An earth auger arrangement wherein a power source is mounted on wheels for moving the power source over the earth's surface with means connected to the power source for relaying power to a transmission with which an auger is connected. Handle means are connected to the transmission for manually positioning the auger in relation to the earth's surface to penetrate it at a desired angle with throttle means on the handle means to control the power source. Shaft means are pivotally connected to and extend between the power source and the handle means to reduce counter rotation or counter torque from being exerted on the operator when the auger is rotated to penetrate the earth.

1 Claim, 4 Drawing Figures fig. 1
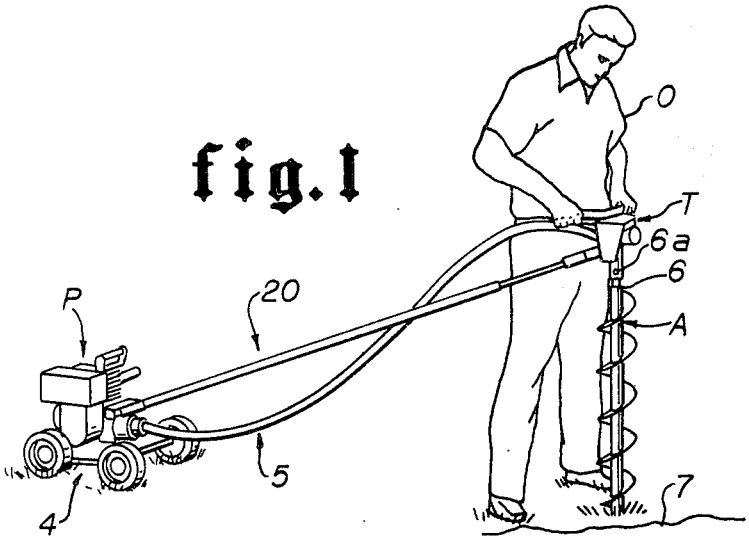
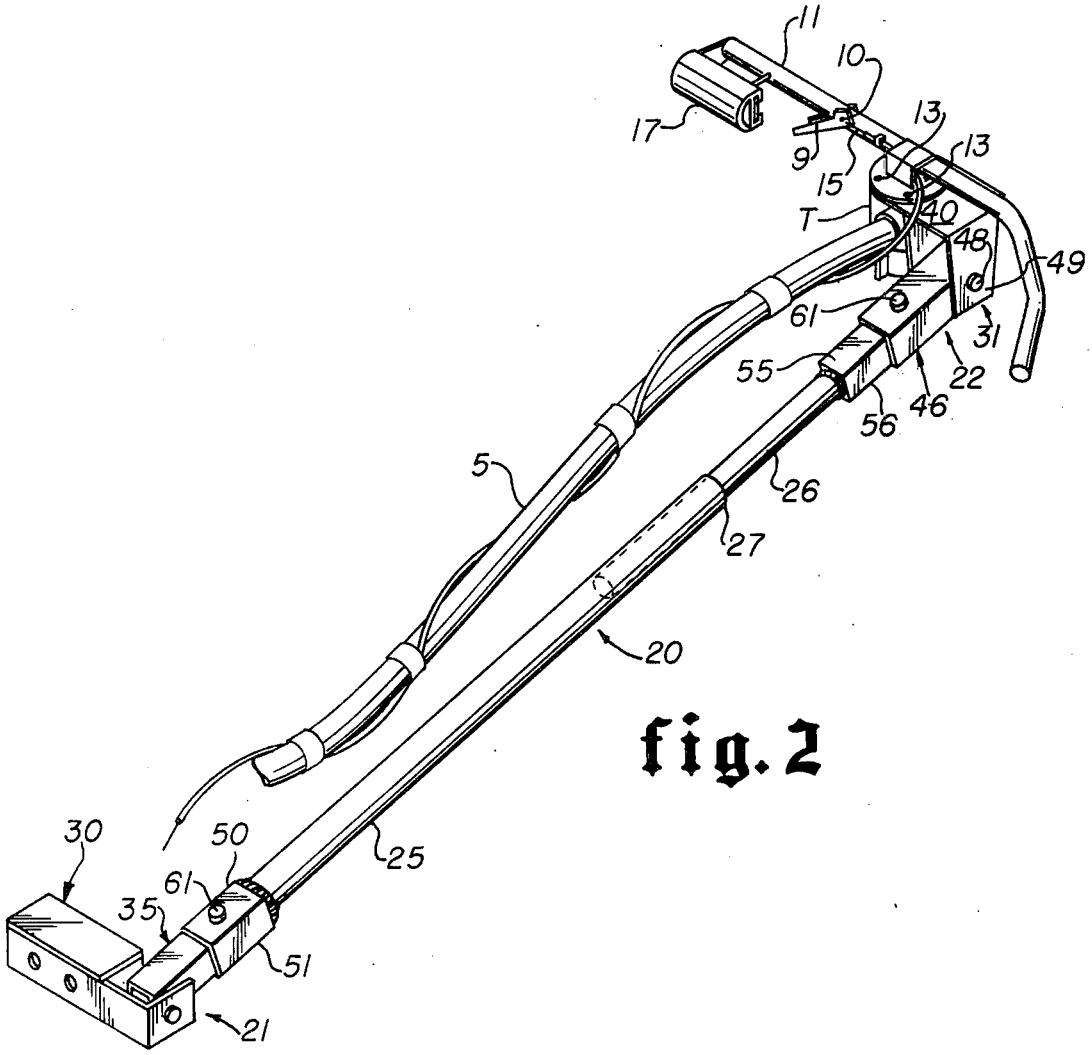
fig. 2

EARTH DRILLS

SUMMARY OF THE INVENTION

Various devices have been provided for enabling an auger to to be manually operated for penetrating the earth's surface at a desired angle. However, when the auger is rotated clockwise to penetrate the earth's surface, a counter-clockwise torque is exerted on the operator which, over a period of time may be substantially uncomfortable. In some types of earth, the force exerted on the operator by the counter torque during rotation of the auger can become uncomfortable even over a relatively short peiord of time.

The present invention provides an arrangement for an earth auger so that the auger can be rotated to penetrate the earth and includes means to absorb the counter rotation or counter torque caused by the clockwise rotation of the auger as it penetrates the earth to thereby substantially reduce, if not completely eliminate the counter torque exerted on the operator while the auger is rotated to penetrate the earth.

Yet another object of the present invention is to provide an arrangement for reducing if not completely eliminating the counter torque created when a power source actuates a manually operated auger to substantially reduce if not completely eliminate the counter torque exerted on the operator produced by the clockwise rotation of the auger as it penetrates the earth.

Other objects and advantages of the invention will become readily apparent from consideration of the following description and drawings.

BRIEF DESCRIPTION OF THE DRAWINGS

FIG. 1 is a perspective view illustrating the present invention in use;

FIG. 2 is an isometric view illustrating details of a preferred form of the present invention.

DESCRIPTION OF THE PREFERRED EMBODIMENTS

Figures 3, 4:
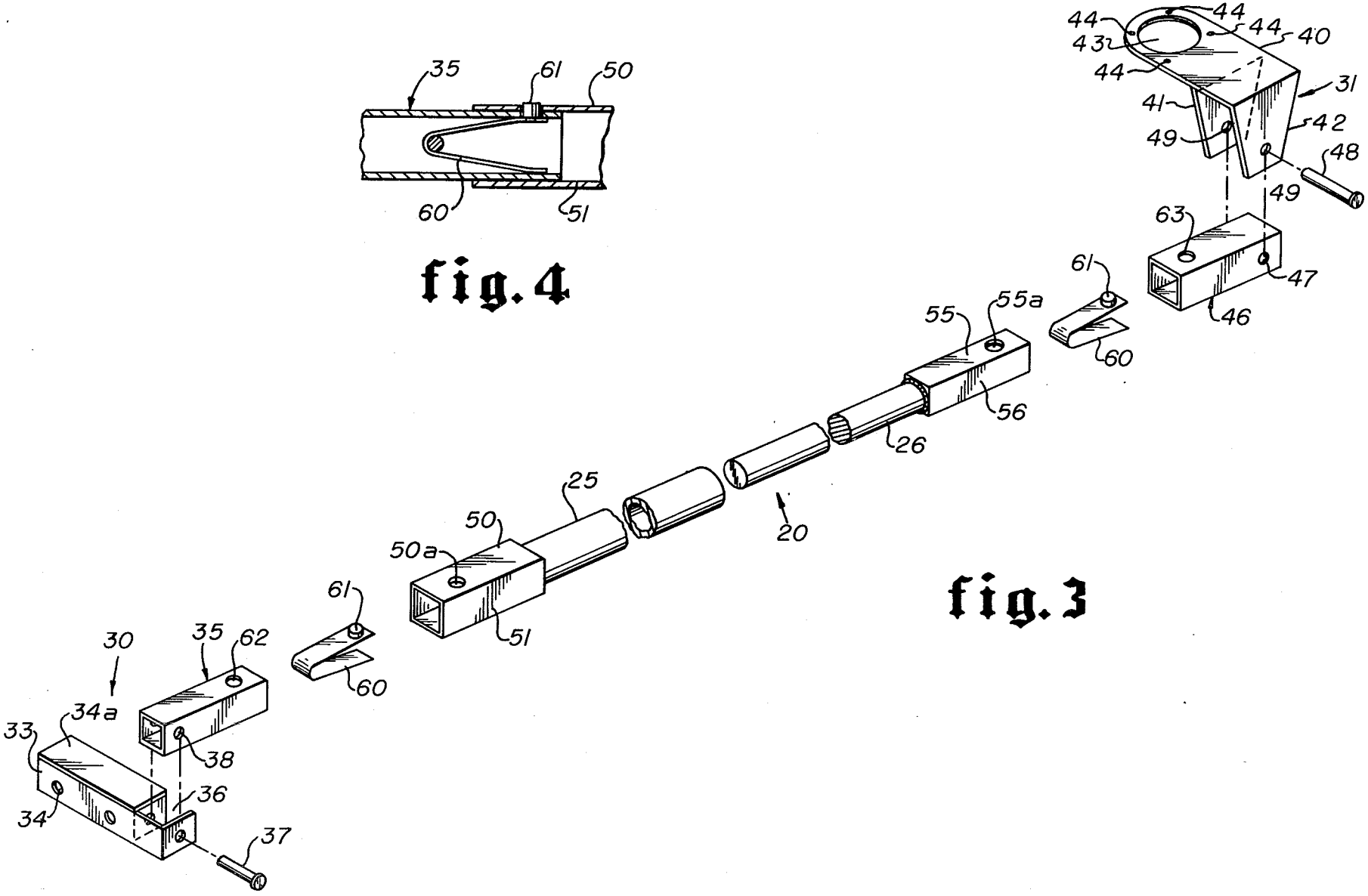
FIG. 3 is an exploded view of the preferred form of the invention shown in FIG. 2 illustrating further structural details.

Attention is first directed to FIG. 1 of the drawings wherein a power source is referred to by the letter P. The power source illustrated in FIG. 1 is shown as being mechanical, that is, an internal combustion engine; however, it may be hydraulic, that is a suitable power source actuating a hydraulic arrangement for conducting hydraulic fluid to hydraulically operate an auger.

In either event, it is preferrable that the power source P be carried on a suitable wheeled support as referred to generally at 4 in FIG. 1 so that it can be moved with ease over the earth's surface by the operator of the auger, illustrated by the letter O in FIG. 1, so that the auger arrangement of the present invention can be moved from location to location with a minimum of ease.

Suitable means referred to generally by the numeral 5 in FIG. 1 are provided for transmitting power from the power source P to a transmission referred to at T in FIG. 1. It can be appreciated that where the power source P is mechanical, the means 5 will be in the form of a flexible shaft or line carried within a flexible housing and rotatable for relaying power from the power source P to the transmission T. When the auger A is hydraulically actuated, hydraulic fluid is supplied by a power source P actuating a pump to pump fluid through hoses to move the transmission T. An auger referred to generally by the letter A is removably secured by pin 6*a* adjacent its upper end 6 to the transmission T and is contructed and arranged to drill a hole in the earth's surface 7 when the transmission T supplies power from the power source P to rotate the auger in a clockwise direction looking downwardly on top of the auger A as is the operator in FIG. 1 of the invention.

The flexible shaft means 5 is again illustrated in FIG. 2. A throttle 9 is pivotally mounted at 10 on handle bar or handle means 11. The handle 11 includes a bracket and a plate which plate is provided with openings 13 so it may be secured to the transmission T by any suitable means such as screws. A flexible line 15 is secured to and extends from the throttle control 9 in a flexible housing, which, if desired, may be connected to the means 5 by any suitable arrangement such as tape, wire or the like and extends to the power source P (not shown in FIG. 2) so that the rotation of the transmission T and the auger A may be controlled by the throttle 9.

Torque control means are referred to generally at 20 in FIG. 2 which is secured at one end referred to generally at 21 to the portable power source P and at its other end referred to generally by the numeral 22 to the transmission T to inhibit counter-clockwise rotation of the transmission and handle means 11 against the operator O when the auger means A is rotated. A suitable pad 17 is mounted adjacent one end of the handle means 11 to abut the left side of the operator during operation of the present invention.

The torque control means 20 includes a first member 25 which telescopically receives a second member 26 therein. The length of the means 5, whether mechanical or hydraulic hoses, is such that when 20 is assembled, member 26 extends into member 25 about 12 inches. In effect, connection 5 prevents 26 from pulling out of 25 when the torque control means 20 is assembled as shown in FIG. 1.

Attention is now directed to FIG. 3 wherein the torque arrangement 20 is again referred to and illustrated in exploded view to more clearly illustrate the details of the embodiment of the invention illustrated in the drawings.

A first bracket means 30 is adapted to be positioned on power source P in any suitable fashion. A second bracket means referred to generally at 31 is adapted to be secured to the transmission T. The first bracket means 30 is shown as including a plate member 33 having holes 34 therein to enable the first bracket 30 to be secured to the power source P. A first socket means 35 may be of any suitable configuration and is illustrated as being square or quadralateral and extends longitudinally. The plate member 34 along with the plate member 34*a* form an opening or space 36 adjacent one end of the first bracket means 30 for receiving the socket means 35 therein. The socket means 35 is pivotally positioned, within the opening 36 in any suitable manner such as the pin 37 fitting through the opening 38 in the socket member 35 and corresponding openings in 33 and 34*a*. Thus, when bracket 30 is secured on power source P, socket means 35 is pivotally supported thereon.

The second bracket means 31 includes a plate member 40 having the laterally extending and spaced members 41 and 42 depending therefrom. The plate member 40 includes a suitable depression 43 extending upwardly out of the plane of the plate member 40 to enable the plate member to be positioned adjacent the top of the transmission T. Openings 44 are provided for receiving screws therethrough and through the openings 13 of the plate on handle 11 to secure the handle member 11, second bracket means 31 and transmission T together.

A second socket means referred to generally at 46 is also illustrated as being hollow and formed in quadralateral shape and longitudinally extending. It is provided with an opening 47 which is adapted to receive the pin 48 that extends through the openings 49 in the spaced depending projections 41 and 42 so that the socket means 46 may be pivotally supported on handle 11 between the depending members 41, 42.

As previously noted the torque control means 20 includes a first member 25 and a second member 26 which are slidably and telescopically positioned together. As previously noted, the members 25 and 26 are of a suitable longitudinal extent so as to extend between the power source P and transmission T and to absorb the counter torque as the auger A is rotated when the auger A and the operator O are in the position referred to in FIG. 1 of the drawings.

The first and second members 25 and 26 in effect form a nonflexible shaft means which extends between and connects the power source P and the transmission T together so that when the auger A is rotated in a clockwise direction to drill a hole in the earth's surface 7, the counter-clockwise reaction is absorbed by the members 25 and 26. The shaft means formed by the first and second members 25 and 26 absorbs the counter torque while the device is positioned adjacent the operator O with the pad 17 engaged with the left side of the operator.

The end 50 of the first member 25 is provided with a female socket member 51 adapted to telescopically receive the socket means 35 pivotally carried by the power source P.

Similarly the end 55 of the second member 26 includes a male socket member 56 which is adapted to be received within the hollow socket means 46 supported by the handle means 11.

In order to retain the ends 50 and 55 releasably secured in first and second bracket means 30 and 31 respectively, any suitable arrangement such as that illustrated may be employed. Attention is directed to FIG. 4 wherein an enlarged sectional view of the first socket means 35 and end 50 of the first member 25 is shown. A leaf spring member 60 is received within the socket means 35 and includes a projection 61 which is urged outwardly of the hole 62 therein when the leaf spring is inserted within the socket means 35. It will be noted that the projection 61 extends above the surface of the socket means 35 so that when the end 50 is telescopically positioned over the socket means 35, the opening **50*a* in the socket member 50 will enable the projection 61 to extend therethrough so as to releasably secure the first member 25 with the first bracket 30** carried by the power source P.

The end 55 of the second member 26 carries a leaf spring member 60 that has a projection 61 thereon in the form as illustrated in FIGS. 3 and 4 of the drawings which projection 61 extends through the opening **55*a* in the end 55 of the second member 26. Thus when the male end 55 of the second member 26 is inserted into the female socket means 46, the projection 61 extends through the hole 63 when it is in alignment therewith so that the second member 26** may be retained in engagement therewith.

During operation of the present invention, it will assume the relationship to the earth's surface 7 as shown in FIG. 1 and the components of the present invention will assume the relationship there illustrated. When the throttle lever 9 is actuated line 15 accelerates power source P. A centrifugal clutch (not shown) normally disengages power source P and transmission T when P idles, but when P is accelerated, the clutch engages and power is transmitted from the power source P through 5 to cause the transmission T to rotate the auger A in a clockwise direction and penetrate the earth's surface. When this occurs a counter-clockwise reaction is transmitted which is absorbed by the torque control means 20. This substantially reduces, if not completely eliminates the counter torque applied to the operator O during rotation of the auger A to drill the opening in the earth's surface. Also since the shaft means 20 is pivotally connected at each end to the power source P and transmission T, respectively it will lower as the auger A drills into the earth 7.

The foregoing disclosure and description of the invention are illustrative and explanatory thereof, and various changes in the size, shape, and materials as well as in the details of the illustrated construction may be made without departing from the spirit of the invention.

What is claimed is:

1. A manually held earth auger arrangement including:

a. a power source mounted on wheels for moving over the earth's surface;

b. a flexible drive shaft connected to said power source;

c. a transmission connected to said drive shaft;

d. an auger removably connected to said transmission;

e. handle means secured to said transmission to manually position said auger in a desired position relative to the earth's surface for penetration therein;

f. throttle means on said handle for controlling said power source;

g. torque control means secured to said power source and extending to said transmission means to inhibit rotation of said handle means when said auger is rotated by said power source, said torque control means including:

1. first longitudinally extending socket means pivotally supported on said power source;

2. second longitudinally extending socket means pivotally supported on said handle means;

3. nonflexible shaft means for connecting to and extending between said first and second socket means, said shaft means including:

a first member having means extending longitudinally from the end thereof to telescopically engage said first longitudinally extending socket means;

a second member telescopically received in said first member and having means extending longitudinally from the end thererof to telescopically engage said second longitudinally extending socket means; and h. spring loaded plunger means carried by each of said first and second longitudinally extending socket means engageable respectively with said first and second members to releasably secure said first and second members to said first and second socket means.

* * * * *